US006331105B1

(12) United States Patent
Lee

(10) Patent No.: US 6,331,105 B1
(45) Date of Patent: Dec. 18, 2001

(54) APPARATUS TO MANUFACTURE GREEN BRICKS

(75) Inventor: Barry W. Lee, New South Wales (AU)

(73) Assignee: Boral Bricks (NSW) Pty. Ltd.

( * ) Notice: Subject to any disclaimer, the term of this patent is extended or adjusted under 35 U.S.C. 154(b) by 0 days.

(21) Appl. No.: 09/615,174

(22) Filed: Jul. 13, 2000

Related U.S. Application Data

(63) Continuation-in-part of application No. 09/075,164, filed on May 8, 1998, now abandoned.

(51) Int. Cl.[7] ..... B28B 11/08

(52) U.S. Cl. ..... 425/324.1; 425/364 R; 425/366; 425/373

(58) Field of Search ..... 425/343, 297, 425/324.1, 328, 329, 364 R, 366, 373

(56) References Cited

U.S. PATENT DOCUMENTS 1,202,581 * 10/1916 Plumb ..... 425/324.1
1,246,411 * 11/1917 Fontaine ..... 425/324.1
3,213,510 * 10/1965 Mizer et al. ..... 425/366
3,350,757 * 11/1967 Bowles ..... 425/302.1
4,419,065 * 12/1983 Cox ..... 425/301
4,495,132 * 1/1985 Johnson ..... 425/305.1

* cited by examiner

*Primary Examiner*—Robert Davis
(74) *Attorney, Agent, or Firm*—Hopgood, Calimafde, Judlowe & Mondolino, LLP

(57) ABSTRACT

An apparatus for making green bricks having the appearance of tumbled brick achieves these results by deforming a slug from which green bricks are made. The slug is deformed by the use of a reciprocating member that alternately retracts and then hits (deforms) the slug. By varying the angle of attack (between the deformation member and the slug), the degree of travel of the deformation member, and the orientation of deformation blades on the deformation member, the green bricks have a deformation pattern that appears fairly random as if they had been tumbled.

11 Claims, 8 Drawing Sheets

APPARATUS TO MANUFACTURE GREEN BRICKS

TECHNICAL FIELD

This application is a continuation-in-part of copending application Ser. No. 09/075,164 filed May 8, 1998 and now abandoned, the disclosure of which is incorporated herein by reference.

The present invention relates to an apparatus for manufacturing bricks and in particular, for manufacturing "green" bricks having a "tumbled" appearance.

BACKGROUND OF THE INVENTION

In the field of brick making, there are generally two types of bricks; "Green" bricks and "Fired" bricks. To manufacture a common brick a soft mixture of clay is extruded through an extrusion device to form a flat horizontally extending column of clay from which clay slugs are produced. These slugs are later cut into a common "brick" shape by passing them through a cutting assembly unit such as a "push through" cutter. Various other assembly units can be included into the brick making production line before or after the cutting unit.

Generally, a "green" brick is defined as a brick which is an amorphous or soft state produced from the clay column coming from the extruder. A "fired" brick on the other hand, is a brick, which once leaving the extrusion device (as a "green" brick), proceeds to a drier and into a kiln wherein the brick is "fired".

It is well known to manufacture bricks having an irregular appearance. This irregular appearance is generally produced by taking either "green" or "fired" bricks and tumbling them. This tumbling action deforms the edges of "green" and chips the edges of "fired" bricks, giving each respective brick a unique appearance.

When green bricks are tumbled, they are placed into a tumbling machine which knocks, folds and generally distorts the shape of the brick. When fired bricks are tumbled, they are placed in a similar tumbling machine and "rumbled". These tumbling machines include a drum mounted for rotation about its longitudinal axis. The internal surface of the drum is provided with a plurality of spaced bars which engage and lift the bricks. The drum is driven by an electric motor.

Unfortunately, this method for producing tumbled fired bricks is extremely noisy and produces significant quantities of dust. Both prior all processes are also very labor intensive.

Bricks produced in this traditional way invariably have to be handled manually because the distortions prevent automatic marshaling and setting equipment being used. Accordingly, tumbled bricks are more costly to manufacture.

OBJECTS OF THE INVENTION

It is an object of the present invention to overcome or ameliorate some of the disadvantages of the prior art, or at least to provide a useful alternative.

It is another object of this invention to mass produce bricks having the appearance of being tumbled without actually tumbling the bricks and incurring losses.

SUMMARY OF THE INVENTION

An apparatus is disclosed herein adapted to receive a slug from which "green" bricks are formed, the slug being elongated and having a rectangular transverse cross section, said apparatus being adapted to deform the slug and comprising:

an elongated base to receive the slug so that the slug extends longitudinally thereof; and at least two deformation members mounted adjacent the base and movable transversely of the base between a retracted position in which the members would be spaced from the slug, and a deformation position in which at least portions of the deformation members are engaged with the slug to cause plastic deformation thereof.

In the above mentioned apparatus, preferably the deformation members include a plurality of deformation members which are moved in a direction generally transverse of the base between retracted and deformation positions.

Preferably, the deformation members are adapted to deform all four longitudinally extending edges of a slug.

It is further preferred that the deformation members be secured to a bar which is pivotally mounted for angular movement about an axis generally parallel to the longitudinal axis of the base.

BRIEF DESCRIPTION OF THE DRAWINGS

A preferred form of the present invention will now be described by way of example with reference to the accompanying drawings wherein.

DETAILED DESCRIPTION OF THE SPECIFIC EMBODIMENTS

Figure 1:
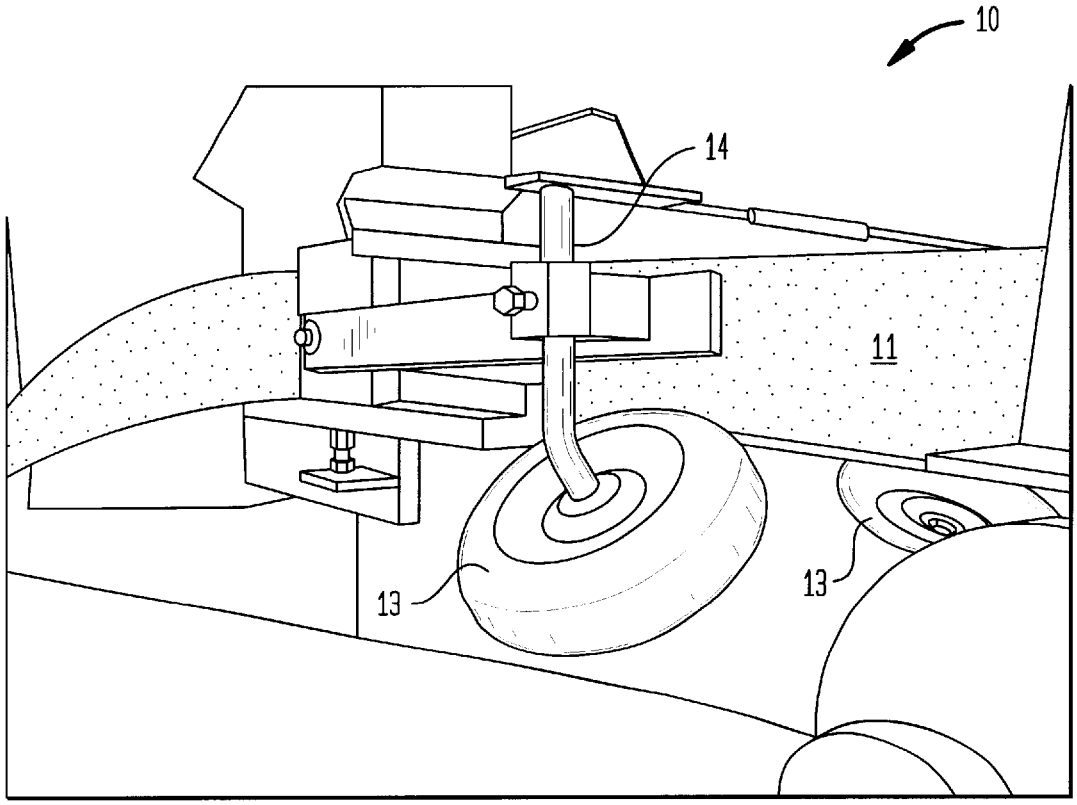
FIG. 1 is a schematic perspective view of an extrusion device which forms a slug from which "green" bricks are formed.
Figure 2:
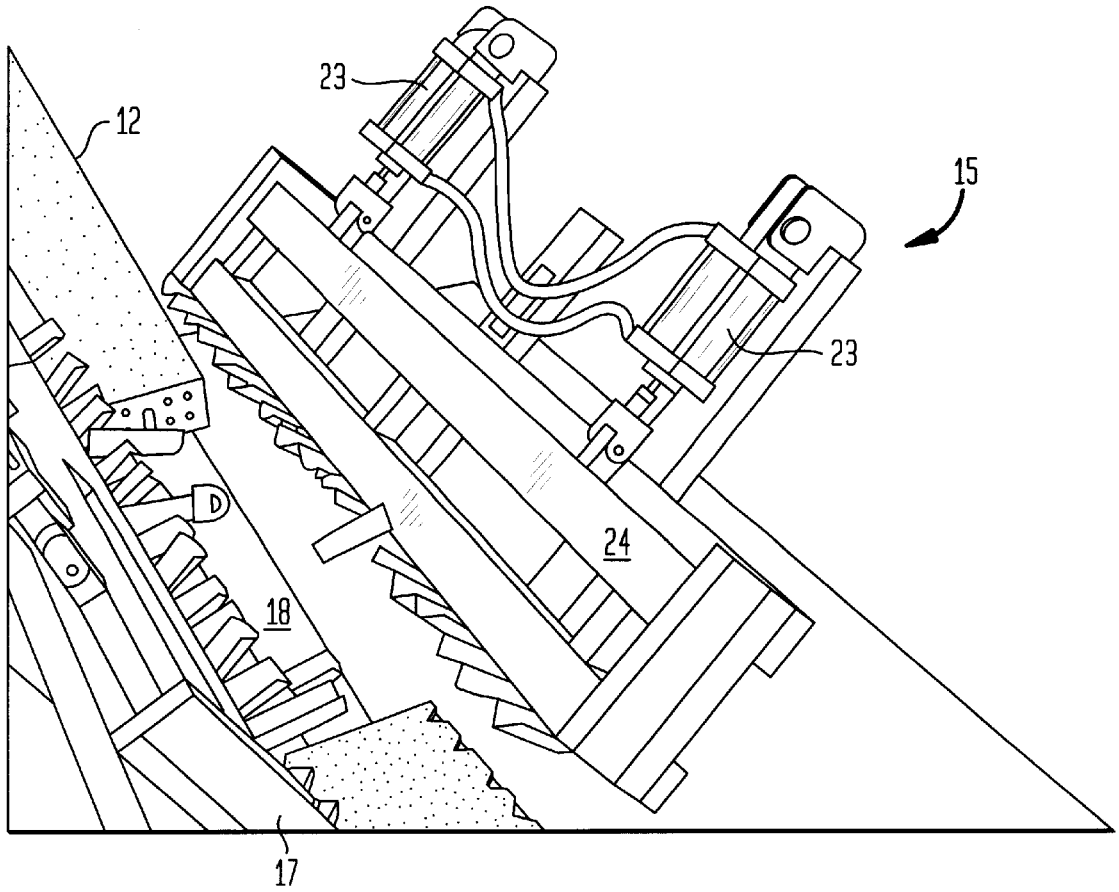
FIG. 2 is a schematic perspective view of an apparatus to deform a slug from the device of FIG. 1.
Figure 3:
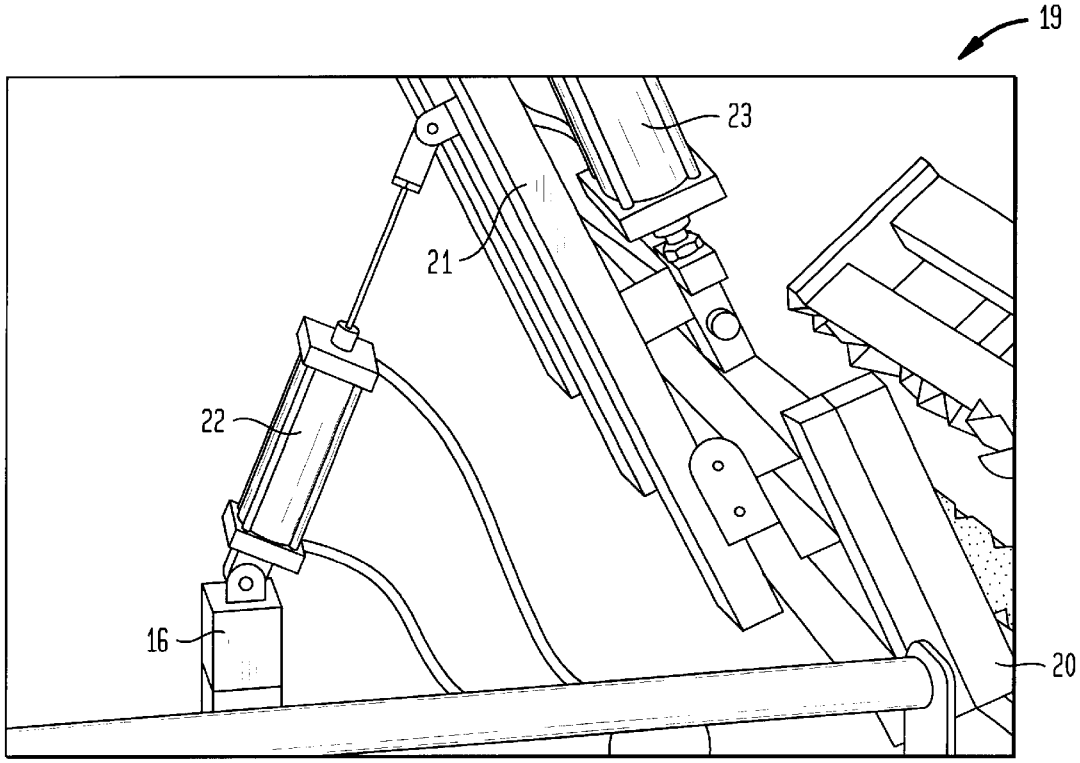
FIG. 3 is a schematic end view of the apparatus of FIG. 2.

In the accompanying drawings there is schematically depicted an extrusion device 10 through which clay is extruded to form a horizontally extending clay column 11 from which slugs 12 are cut. The column 11 is generally rectangular in transverse cross section and passes a pair of rollers 13 which plastically deform one, two or more of the longitudinal edges of the column 11. In particular, the rollers 13 form a "chamfer" along the longitudinal lower edges of the column 11. Each of the rollers 11 is supported by an arm 14, so that the rollers 13 can rotate about an axis inclined to the column 11.

The column 11 passes to a cutting station which transversely cuts the column 11 to form discrete lengths of the clay material. Each discrete length is known as a slug. The slugs 12 are intermittently moved and are delivered one at a time to the deformation apparatus 15.

Figure 4:
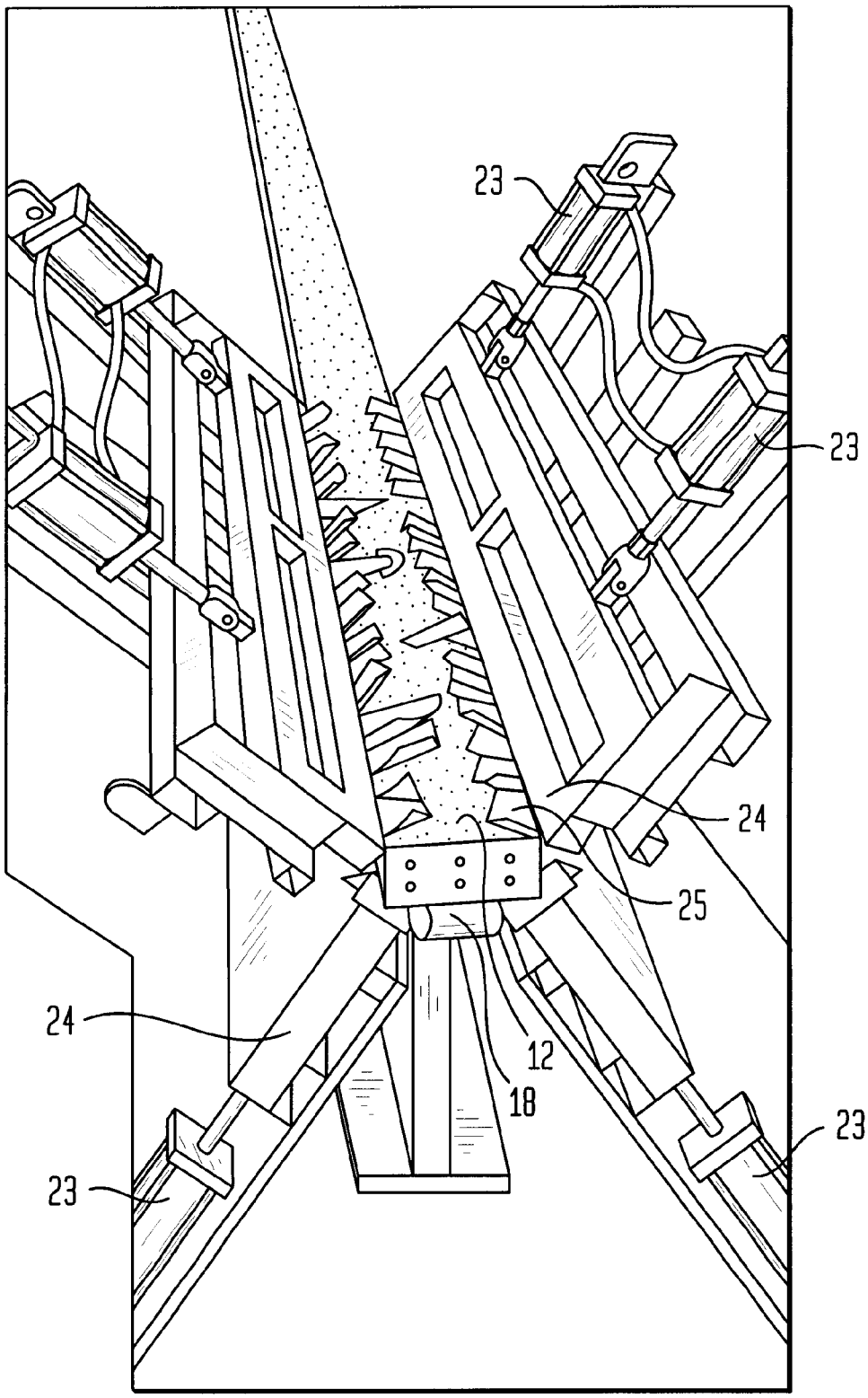
FIG. 4 is a further schematic perspective view of the apparatus of FIG. 2, engaging a slug.
Figure 5:
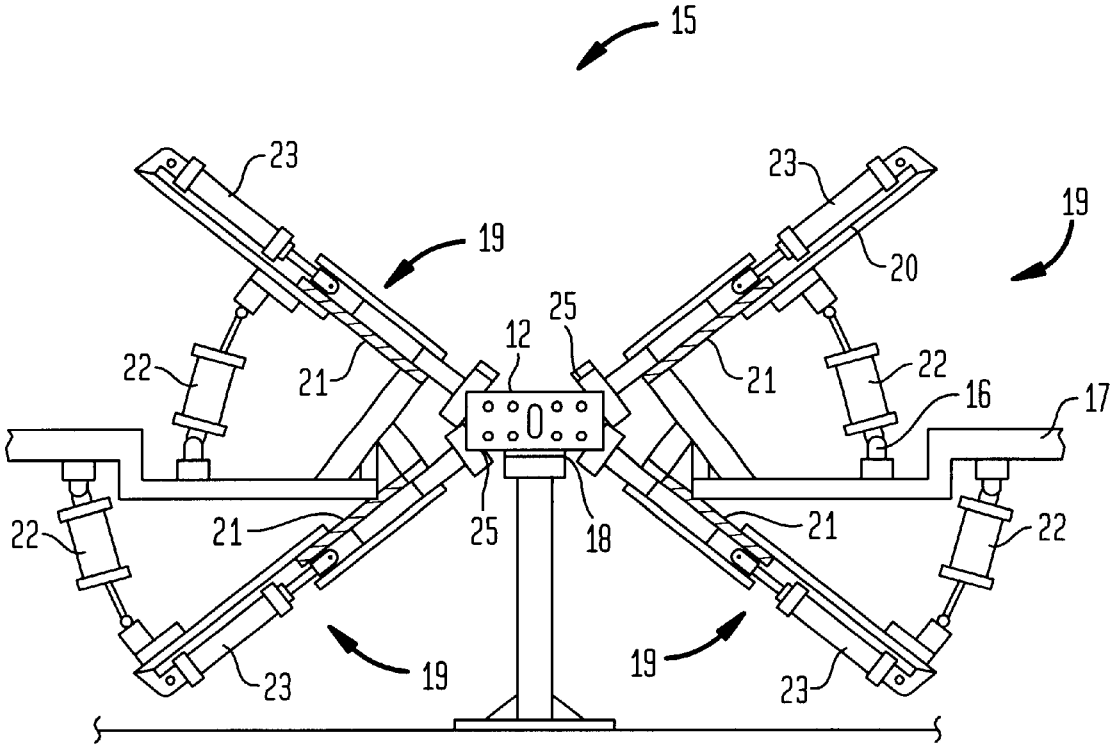
FIG. 5 is a schematic end elevation of the apparatus of FIG. 2.

The deformation apparatus 15 includes a base frame 16 which has a base 17 which is elongated. The base 17 includes a conveyor 18 which receives and locates the slug 12 between at least one pair of deformation assemblies 19. In FIGS. 4 and 5 four deformation assemblies are provided. This advantageous component permits deformation of all longitudinal edges of the slug 12 significantly improving the efficiency of the apparatus 15.

Each assembly 19 includes a support structure 20 which pivotally supports a sub frame 21. The sub frame 21 can pivot about a generally horizontal axis parallel to longitudinal axis of the conveyor 18. Extending from the sub frame 21 is a hydraulic or pneumatic ram 22 which causes angular movement of the sub frame 21.

Mounted on the sub frame 21 are two hydraulic or pneumatic rams 23, which cause linear reciprocation of a deformation bar 24 (FIG. 4) relative to the sub frame 21. The deformation bar 24 is provided with one or more deformation blades 25 (FIG. 4), which engage the slug 12 to cause deformation thereof. The deformation blades 25 are irregular in shape so as to cause deformation of the adjacent corner of the slug 12.

Figure 6:
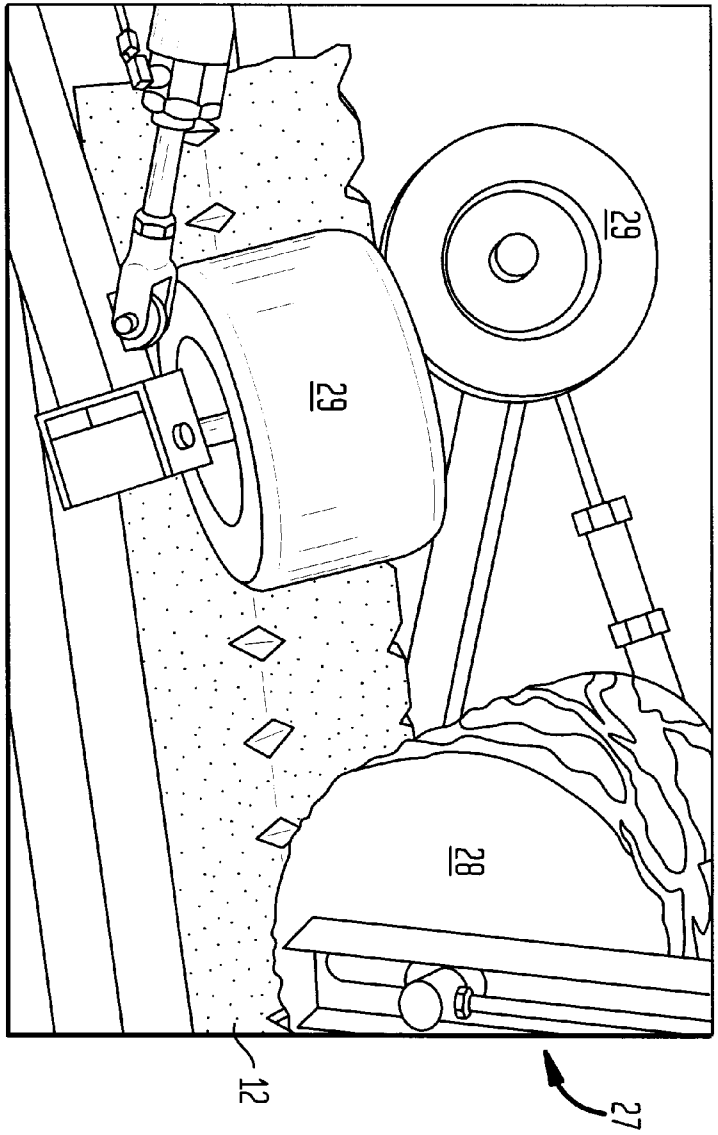
FIG. 6 is a schematic perspective view of a device to further modify the slug deformed by the apparatus of FIG. 2.
Figure 7:
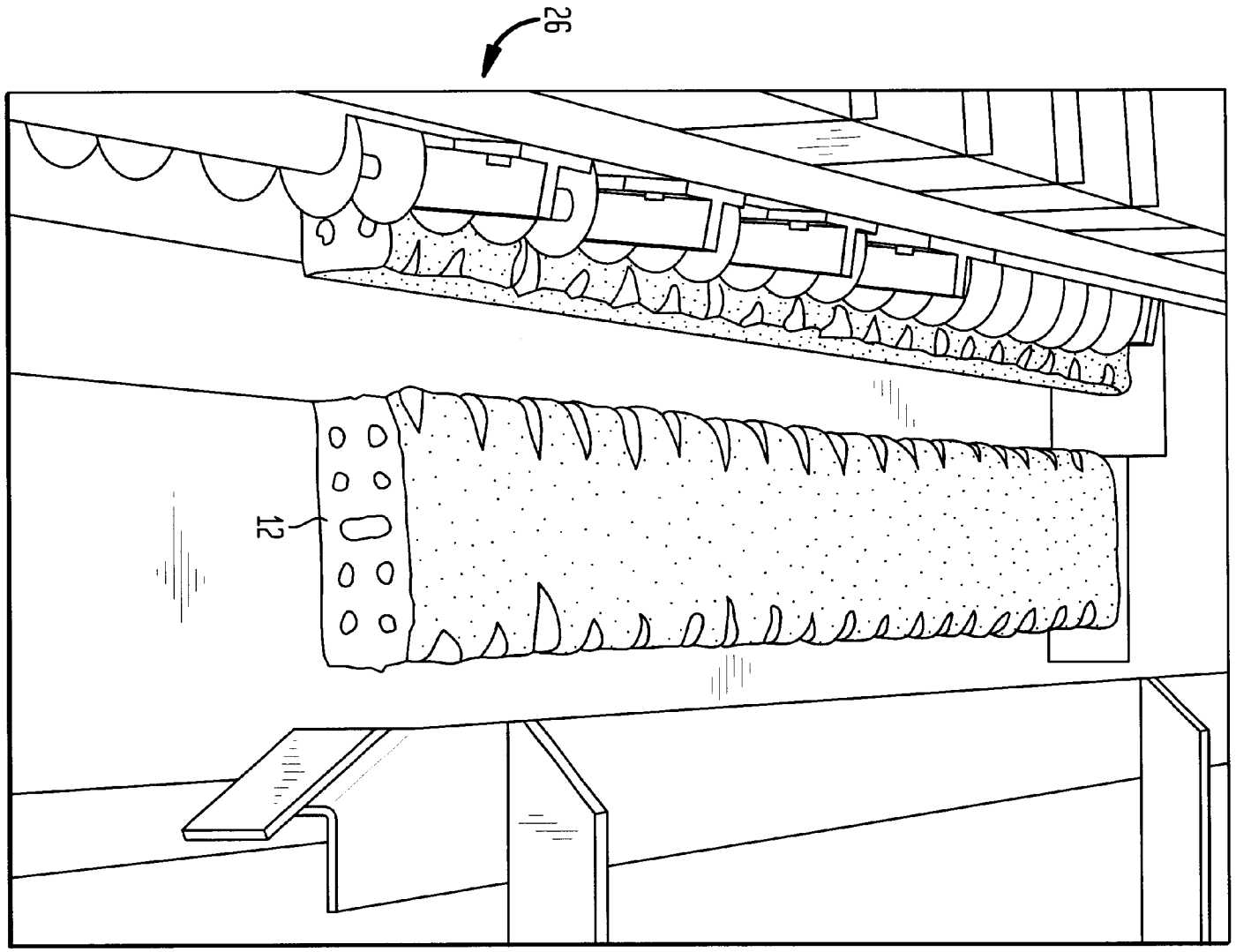
FIG. 7 is a schematic perspective view of a slug about to enter a "push-through" cutter.
Figure 8:
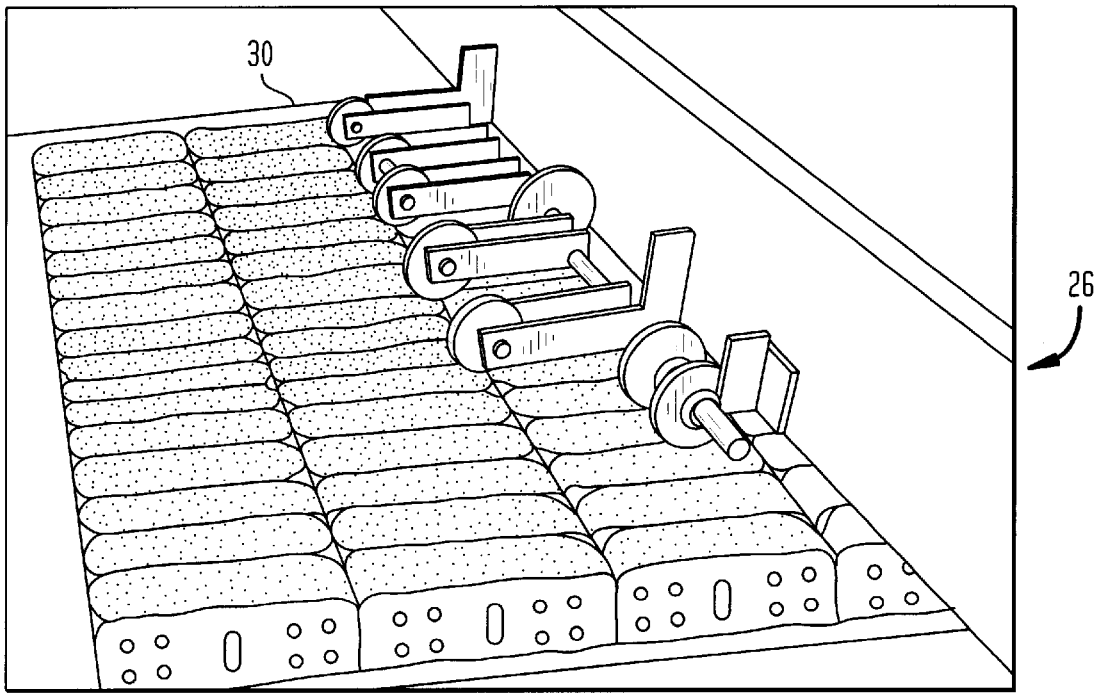
FIG. 8 is a schematic perspective view of green bricks leaving the "push-through" cutter.

The conveyor 18 delivers the deformed slug 12 to a "push-through" cutter 26 (FIG. 7) via a scuffing station 27 (FIG. 6). The station 27 includes a roller 28 which engages the upper surface of he slug 12 and cause scuffing thereof. The roller 28 has a generally horizontal axis of rotation, which axis is inclined to the longitudinal axis of the slug 12 by an acute angle. The longitudinal edges of the slug 12 are also engaged by rollers 29 which again deform the slug 12 to remove sharp edges.

The cutter assembly 26 (FIG. 7) is of a conventional configuration, in that the slug 12 is pushed through a series of wire cutters. At the exit of the cutter 26, there is provided a plurality of rollers 30, which again add to the deformation of the bricks. The rollers 30 engage the longitudinal edges of the "green" bricks leaving the cutter 26.

In summary, an apparatus is provided for producing "green" bricks from a soft plastically deformable clay mixture wherein means are provided for extruding said soft clay mixture into a shape of a flat elongated column of specified thickness for brick making, said apparatus including a base structure cooperatively associated with said extruding means and adapted for receiving said flat column. The flat column has a plurality of longitudinal edges extending along said column having a rectangular cross section.

At least two deformation members are provided mounted adjacent the base structure adapted to move transversely of the base between a retracted position in which the members would be spaced from the slug and a deformation position in which at least a portion of the deformation members is engaged with the slug to effect plastic deformation thereof.

In the above described preferred embodiment, it should be appreciated that the green bricks produced have an almost random distribution of deformations so as to simulate green bricks that have been tumbled. The "random" deformations are produced by varying the inclination of the sub frame 21, and varying the length of movement of the bar 24, together with the scuffing and irregular distribution of deformations produced by the rollers 30. In addition, the deformation blades can be mounted effective to allow each blade to move slightly (e.g., rotate about a single attachment point) to contribute to the randomness of the orientation of the blades as they deform the plastic material.

Although the invention has been described with reference to specific examples, it will be appreciated by those skilled in the art that the invention may be embodied in many other forms.

What is claimed is:

1. An apparatus to receive a slug from which "green" bricks are formed, the slug being elongated and having a rectangular transverse cross section so as to provide two longitudinal side faces, an exposed top face, and a bottom face, said top and bottom faces and each side face forming an edge, said apparatus being adapted to deform the slug and having:

an elongated base to receive the slug so that the slug extends longitudinally thereof; and at least two deformation members mounted adjacent the base and movable transversely of the base between a retracted position in which each of said deformation members is spaced from the slug, and a deformation position in which at least portions of each of said deformation members are engaged with the slug at spaced locations along at least one of the edges of the slug to cause irregular plastic deformations, at least one first ram member for causing angular movement of at least one of said deformation members about the longitudinal direction of the base; and a second ram member for causing reciprocation of each of said deformation members between said deformation position and said retracted position.

2. The apparatus of claim 1, wherein the deformation members include a plurality of deformation blades which engage the slug to cause said deformation.

3. The apparatus of claim 2, wherein the deformation members pivot about said longitudinal direction of the base.

4. The apparatus of claim 1, 2, or 3, further including at least one roller mounted on said base to engage an edge of a face of the slug to cause deformation thereof.

5. The apparatus of any of claims 1, 2, or 3, wherein the deformation members are adapted to deform at least two longitudinally extending edges of the slug.

6. The apparatus of claim 5, wherein the deformation members are adapted to deform four longitudinally extending edges of the slug.

7. The apparatus of claims 1, 2, or 3, further including at least one roller adapted to engage each deformation edge of the slug to cause further deformation thereof.

8. The apparatus of claims 1, 2, or 3, further including a clay extruding device which produces a clay column which is transversely cut to provide the slugs, and at least one roller to chamfer a longitudinal edge of the column by engagement therewith.

9. An apparatus for producing "green" bricks from a soft plastically deformable clay mixture which comprises:

means for extruding said soft clay mixture into a shape of a flat elongated column of specified thickness for brick making;

a base structure cooperatively associated with said extruding means for receiving said flat clay column;

said clay column having a plurality of longitudinal edges extending along said clay column, said column having a rectangular cross section transverse thereof;

at least two deformation members mounted adjacent the base structure and movable transversely of the base between a retracted position in which each of said deformation members would be spaced from the slug, and a deformation position in which at least portions of each of said deformation members is engaged with the slug to cause irregular plastic deformation thereof, at least one first ram member for causing angular movement of at least one of said deformation members about the longitudinal direction of the base; and a second ram member for causing reciprocation of each of said deformation members between said deformation position and said retracted position.

10. The apparatus of claim 9, wherein the orientation of said base and at least one of said deformation members is variable.

11. The apparatus of claim 9, wherein the amount of movement of at least one of said deformation members between said retracted position and said deformation position is variable.

* * * * *